US011643824B2

(12) United States Patent
Chen

(10) Patent No.: US 11,643,824 B2
(45) Date of Patent: May 9, 2023

(54) FLOOR FRAME

(71) Applicant: Hung-Chun Chen, Kaohsiung (TW)

(72) Inventor: Hung-Chun Chen, Kaohsiung (TW)

( * ) Notice: Subject to any disclaimer, the term of this patent is extended or adjusted under 35 U.S.C. 154(b) by 0 days.

(21) Appl. No.: 17/489,949

(22) Filed: Sep. 30, 2021

(65) Prior Publication Data

US 2022/0112729 A1 Apr. 14, 2022

(30) Foreign Application Priority Data

Oct. 8, 2020 (TW) ..... 109135005

(51) Int. Cl.
*E04F 15/024* (2006.01)
*E04F 15/02* (2006.01)
*E04B 5/14* (2006.01)

(52) U.S. Cl.
CPC ..... *E04F 15/02458* (2013.01); *E04B 5/14* (2013.01); *E04F 15/02194* (2013.01); *E04F 15/02452* (2013.01); *E04F 2015/0205* (2013.01); *E04F 2015/02077* (2013.01)

(58) Field of Classification Search
CPC ..... E04F 15/02458; E04F 15/02452; E04F 2015/0205; E04F 2015/02077; E04F 15/02194; E04B 5/14
USPC .... 52/477, 780, 772, 762, 482, 299, 506.06, 52/403.1
See application file for complete search history.

(56) References Cited

U.S. PATENT DOCUMENTS 4,622,792 A * 11/1986 Betts ..... E04F 15/02183 52/777
4,999,964 A * 3/1991 Taylor ..... E04B 5/46 52/745.05
6,862,855 B1 * 3/2005 Milum ..... E04F 15/02005 52/471
6,990,777 B2 * 1/2006 Poliacek ..... E04F 15/02005 52/302.1
10,570,626 B1 * 2/2020 Kim ..... E04F 15/02464
10,920,430 B1 * 2/2021 Kim ..... E04F 15/02405
2003/0196402 A1 * 10/2003 Roen ..... E04B 9/18 52/507
2021/0164224 A1 * 6/2021 Kim ..... F16B 7/187

FOREIGN PATENT DOCUMENTS

EP 0710750 A2 5/1996
KR 200378489 Y1 3/2005

* cited by examiner

*Primary Examiner* — Brent W Herring
(74) *Attorney, Agent, or Firm* — Karin L. Williams; Alan D. Kamrath; Mayer & Williams PC

(57) ABSTRACT

A floor frame includes at least two spaced longitudinal support strips and at least one lateral support strip. Each longitudinal support strip has longitudinal upper and lower portions and a pair of longitudinal side walls. A shoulder is designed on at least one of the pair longitudinal side walls and located between the longitudinal upper and lower portions. Two shoulders of the two longitudinal support strips are opposite to each other. The lateral support strip includes lateral upper and lower portions and a pair of lateral side walls. Two ends of the lateral support strip are placed on the two shoulders of the longitudinal support strips, respectively. A plurality of longitudinal and lateral support strips constitutes a grid-type structure under the distribution of longitudinal and lateral directions to provide the placement and fixation of a plurality of floor panels.

14 Claims, 11 Drawing Sheets

FLOOR FRAME

BACKGROUND OF THE INVENTION

1. Field of the Invention

The present invention relates to a floor frame and, more particularly, to a floor frame structure for placements of floor tiles in a building.

2. Description of the Related Art

It is usual for a decoration project of a building to lay floor panels, for example, ceramic tiles or marble tiles, which promote aesthetics and durability of a floor. In particular, ceramic tiles or marble tiles laid on a building's roof and bathroom floor are known for their material characteristics of preventing water in the use environment from penetrating into the floor and causing water leakage in the lower living environment. Furthermore, floor tiles may squeeze, crack or pop up when troublesome events occur, for example, constructional deficiency, low-grade cements, inadequate clearances between tiles, or excessive changes of floor tiles relative to concretes in an extremely hot or cold weather. For the construction of repairing defective floor tiles, a large area of tiles including cracked, protuberant and adjoining ones should be smashed, removed and replaced by new tiles rearranged and laid on the floor. The repair work is very complicated and inconvenient. Further, on the laying of floor tiles on the roof of the building and the bathroom, the implementation environment must prevent rain and water from leaking downward at junctures of floor tiles. In the solution of the prior art to prevent water permeation, the waterproof paints preceding placements of floor tiles are spread on the floor in advance. However, the waterproof paints for long-term use probably cracks and exacerbates water permeation and particular degenerates in high-temperature environment, e.g., roof, being sustained exposure to sunlight.

"Panel connecting system for floors, especially for outdoor and humid spaces" disclosed in EP 0710750A2 describes a composite panel system including panels 2 which lie on side rails 10 and cross rails 12. Each of the side and cross rails 10, 12 is provided with resilient supports 16 on which the panels 2 rest. Elastic sealing strips 32 are respectively provided at the middle sections of the top ends of the side and cross rails 10, 12 to provide sealing between two adjacent panels 2. Furthermore, the cross rail 12 is provided with drainage channels 28 at both sides of the elastic sealing strip 32 to collect the leaked liquid. The elastic sealing strip 32 has a substantially double T-shaped cross-section. The lower portion of the elastic sealing strip 32 is fixed on the side rail 10 or the cross rail 12, and the upper portion of the elastic sealing strip 32 is pressed against one end of the panel 2. However, the upper portion of the elastic sealing strip 32 will deform under long-term pressure on the elastic sealing strip 32 against which the panel 2 is pressed. Since the top end of the cross rail 12 is designed with drainage channels 28 corresponding to the junction of two adjacent panels 2 to form an open hollow form, once elastic sealing strip 32 is aging or the amount of deformation is too large, a liquid-permeable gap will be formed between the panel 2 and the elastic sealing strip 32, which will cause serious leakage between two adjacent panels 2. In the case of heavy rain, the leakage rate will be quite fast, and the accumulated water will overflow from the drainage channels, causing serious water leakage.

A more convenient construction structure should be provided to placements of traditional floor tiles for easy installations, removals or reparations of floor tiles. Moreover, a good-quality design should consider a measure of preventing water permeation in addition to a convenient construction.

BRIEF SUMMARY OF THE INVENTION

Thus, an objective of the present invention is to provide a floor frame with which floor tiles are laid, dismantled or repaired conveniently during construction and water permeation into a floor is prevented. Furthermore, the floor frame has the advantages of less chance of floor tiles squeezing, cracking or popping up due to inadequate clearances between adjoining tiles laid on the floor.

To achieve this and other objectives, a floor frame of the present invention comprises at least two spaced longitudinal support strips and at least one lateral support strip. Each longitudinal support strip has an elongate strip body extending in a longitudinal direction of the floor frame. Each longitudinal support strip includes longitudinal upper and lower portions spaced in a vertical direction perpendicular to the longitudinal direction and a pair of longitudinal side walls spaced in a lateral direction perpendicular to the longitudinal and vertical directions. A shoulder is designed on at least one of the pair of longitudinal side walls and located between the longitudinal upper and lower portions. Two shoulders of two adjacent longitudinal support strips are opposite to each other. The lateral support strip has an elongate strip body extending in the lateral direction and includes two ends spaced in the lateral direction. The lateral support strip further includes lateral upper and lower portions spaced in the vertical direction and a pair of lateral side walls spaced in the longitudinal direction. The two ends of the lateral support strip are placed on the two opposite shoulders of the two adjacent longitudinal support strips, respectively.

Preferably, a vertical distance between the lateral upper portion and the lateral lower portion of the lateral support strip is approximately equal to a vertical distance between the longitudinal upper portion and the shoulder of the longitudinal support strip.

In an embodiment, the longitudinal upper portion of the longitudinal support strip is provided with a first rib extending in the longitudinal direction, and the lateral upper portion of the lateral support strip is provided with a first fin extending in the lateral direction.

In a preferred embodiment, the longitudinal upper portion of the longitudinal support strip is further provided with at least one second rib extending in the longitudinal direction and spaced from the first rib, and the lateral upper portion of the lateral support strip is further provided with at least one second fin extending in the lateral direction and spaced from the first fin.

In an embodiment, at least one buffer strip is provided on both the longitudinal upper portion of each longitudinal support strip and the lateral upper portion of each lateral support strip.

In an embodiment, a first buffer strip is embedded between the first rib and the second rib, and a second buffer strip is embedded between the first fin and the second fin.

Preferably, the buffer strip has an upper surface provided with embossing.

In a preferred embodiment, at least one longitudinal side wall of the longitudinal support strip is provided with a water collection trough extending in the longitudinal direction, and at least one lateral side wall of the lateral support strip is provided with a water drain extending in the lateral direction.

Preferably, the longitudinal upper portion of the longitudinal support strip is provided with two second ribs which are respectively arranged on two sides of the first rib.

Preferably, the lateral upper portion of the lateral support strip is provided with two second fins which are respectively arranged on two sides of the first fin.

In an embodiment, the first rib of the longitudinal support strip extends from the longitudinal side wall opposite to the shoulder of the longitudinal support strip. A water collection trough extends at a lower end of the longitudinal side wall provided with the shoulder. The first fin of the lateral support strip extends from one of the two lateral side portions, and a water drain extends at the lateral side portion opposite to the first fin.

In a preferred embodiment, the floor frame further includes at least one reinforcing strip including an elongate strip body extending in the lateral direction. The reinforcing strip includes upper and lower faces spaced in the vertical direction and a pair of side walls spaced in the longitudinal direction. A vertical distance between the upper face and the lower face of the reinforcing strip is approximately equal to the vertical distance between the lateral upper portion and the lateral lower portion of the lateral support strip. Two ends of the reinforcing strip are placed on the two opposite shoulders of the two adjacent longitudinal support strips, respectively.

In an embodiment, a longitudinal extension strip extends outward from the longitudinal side wall of the longitudinal support strip, and a side wall opposite to the longitudinal side wall extends upward from an outer end of the longitudinal extension strip to define a water collection trough between the longitudinal side wall and the side wall. A wing portion extends outward from an upper end of the side wall in the lateral direction and has a height in the vertical direction which is approximately equal to a height of the shoulder in the vertical direction. One end of the lateral support strip is placed on both the shoulder portion and the wing portion of the longitudinal support strip. A lateral extension strip extends outward from the lateral side wall of the lateral support strip to define a water drain, and an outer side of the water drain of the lateral support strip is provided with a coupling portion. A fastener extends through the coupling portion of the lateral support strip and the wing portion of the longitudinal support strip to combine the lateral support strip with the longitudinal support strip.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
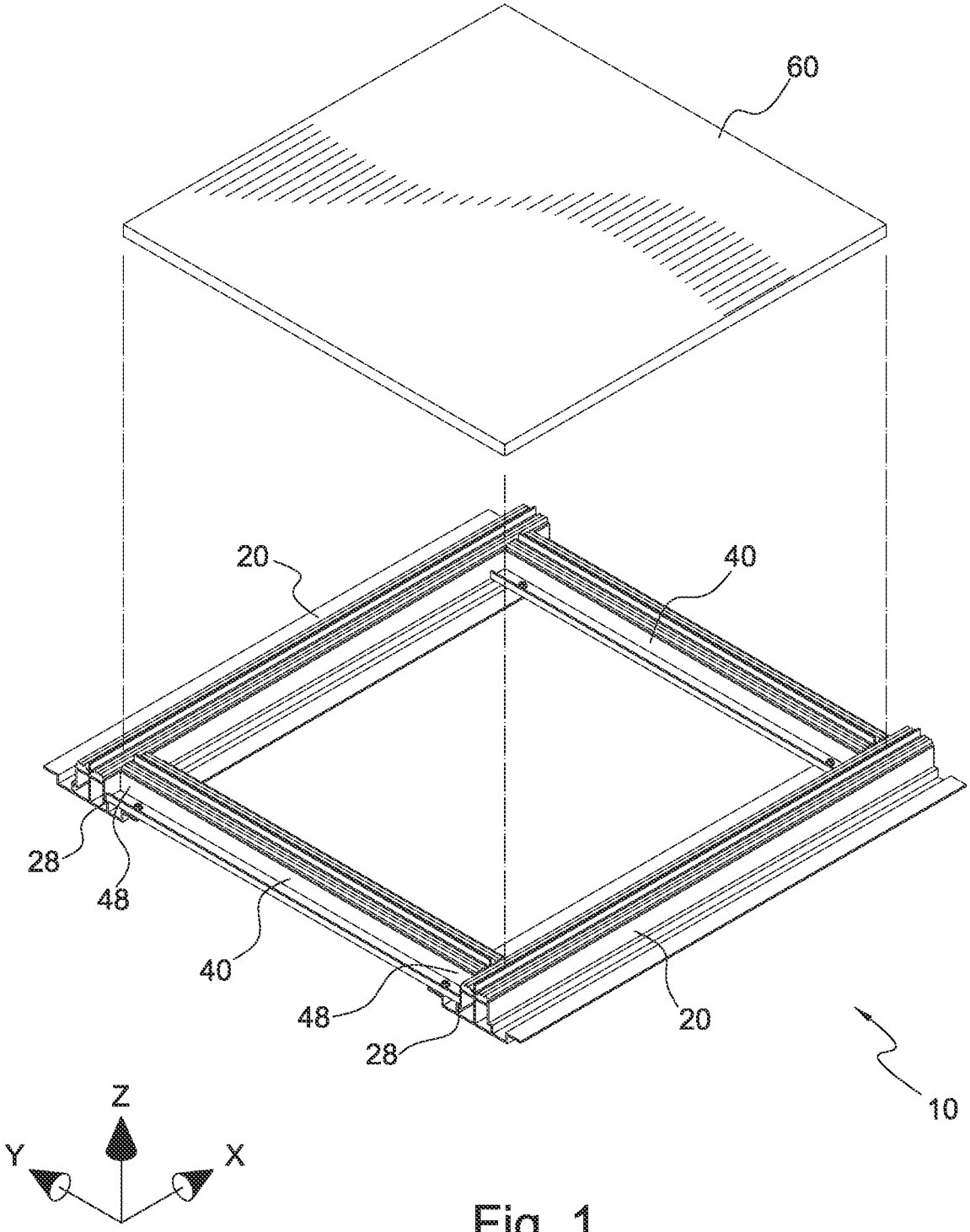
FIG. 1 is a perspective view of a floor frame in accordance with an embodiment of the present invention, with a floor panel separated from the floor frame.
Figure 2:
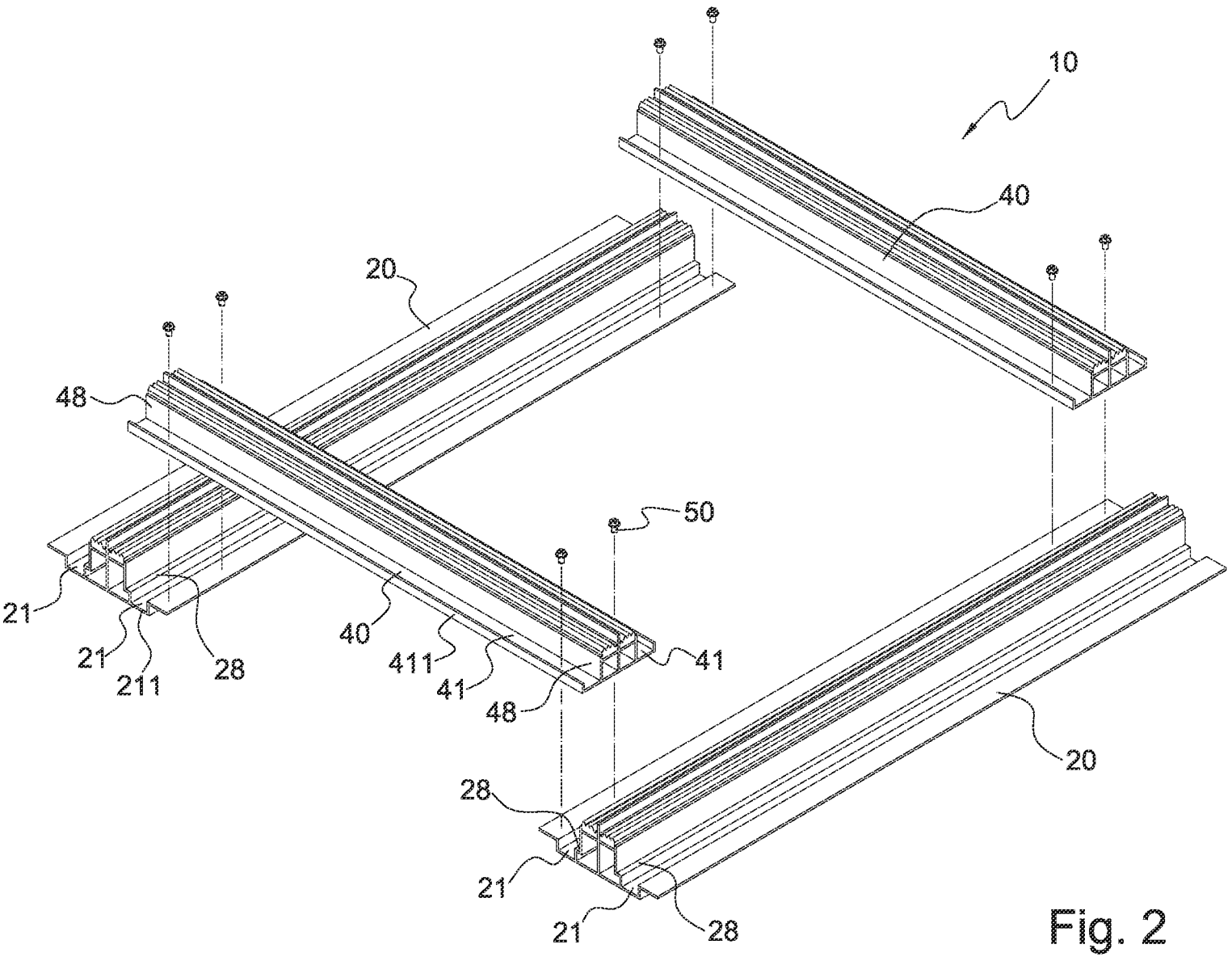
FIG. 2 is an exploded view of the floor frame in FIG. 1.
Figure 3:
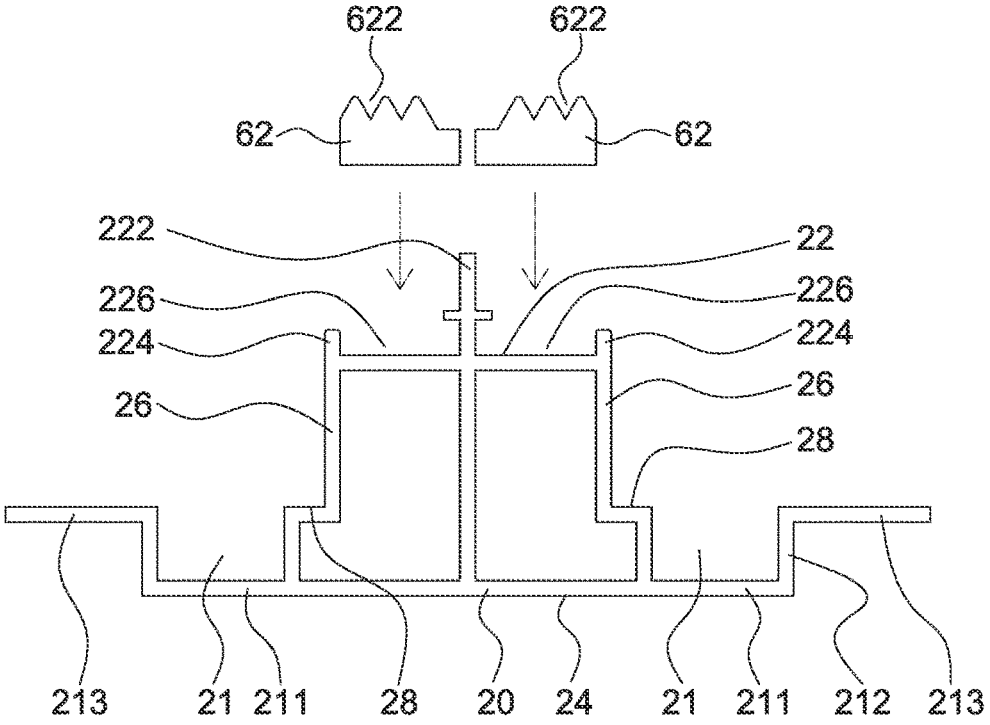
FIG. 3 is a schematic view for one end of a longitudinal support strip in FIG. 2, with two buffer strips separated from the longitudinal support strip.
Figure 4:
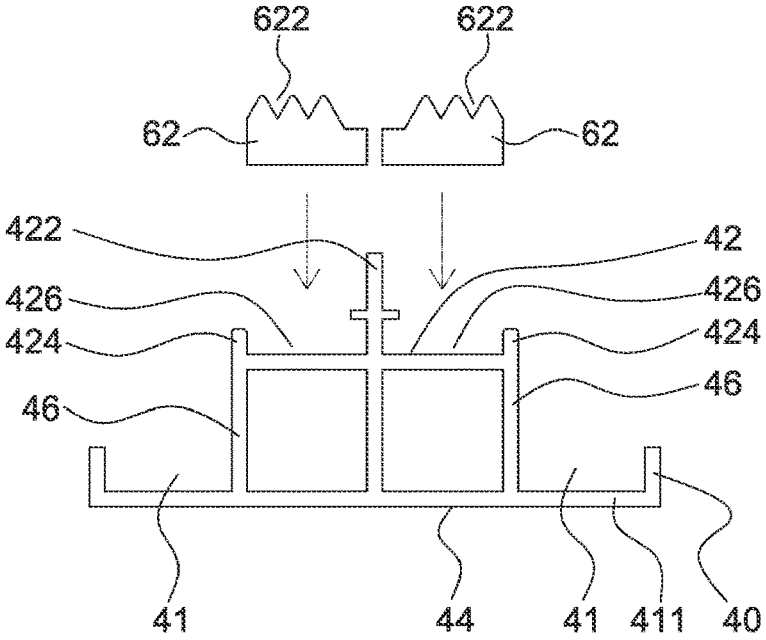
FIG. 4 is a schematic view for one end of a lateral support strip in FIG. 2, with two buffer strips separated from the lateral support strip.

A floor frame 10 according to an embodiment of the present invention is shown in FIGS. 1 through 5 of the drawings and includes at least two longitudinal support strips 20 and at least one lateral support strip 40. The longitudinal support strip 20 has an elongate strip body extending in a longitudinal direction (X) of the floor frame 10. The longitudinal support strip 20 includes longitudinal upper and lower portions 22 and 24 spaced in a vertical direction (Z) of the floor frame 10 perpendicular to the longitudinal direction (X) and a pair of longitudinal side walls 26 opposed and spaced from each other in a lateral direction (Y) of the floor frame TO perpendicular to the longitudinal and vertical directions (X,Z). A shoulder 28 between the longitudinal upper portion 22 and the longitudinal lower portion 24 is designed on at least one longitudinal side wall 26. In this embodiment, two shoulders 28 are designed on two longitudinal side walls 26 of the longitudinal support strip 20, respectively.

The lateral support strip 40 has an elongate strip body extending in the lateral direction (Y) and includes two ends 48 spaced in the lateral direction (Y). The lateral support strip 40 further includes lateral upper and lower portions 42 and 44 spaced in the vertical direction (Z) and a pair of lateral side walls 46 opposed and spaced in the longitudinal direction (X). A vertical distance between the lateral upper portion 42 and the lateral lower portion 44 is approximately equal to a vertical distance between the longitudinal upper portion 22 and the shoulder 28 of the longitudinal support strip 20.

With a configuration of the above structure, at least two horizontally arranged longitudinal support strips 20 with their two shoulders 28 being opposite to each other are mounted on a building's floor, and the at least one lateral support strip 40 being perpendicular to the longitudinal support strips 20 spans between the opposite shoulders 28 of the two longitudinal support strips 20. In this embodiment, each end 48 of the lateral support strip 40 is placed at the shoulder 28 of a corresponding longitudinal support strip 20 and securely fastened by fasteners 50 such as screws. After an adhesive layer (not shown), for example resin or cement, is coated on both the longitudinal upper portion 22 of each longitudinal support strip 20 and the lateral upper portion 42 of the lateral support strip 40, a floor panel 60 can be placed and fixed on both the longitudinal upper portion 22 and the lateral upper portion 42. The floor panel 60 can be a floor tile made of ceramics, marble, wood, metal, etc. The two longitudinal support strips 20 and the lateral support strip 40 striding across the longitudinal support strips 20 will form a basic frame-supporting unit to support the bottom periphery of the floor panel 60.

In this embodiment, a plurality of longitudinal support strips 20 are spaced in the lateral direction (Y), and a plurality of lateral support strips 40 are spaced in the longitudinal direction (X) with the two ends 48 of each lateral support strip 40 spanning between the shoulders 28 of two adjacent longitudinal support strips 20. The longitudinal support strips 20 and the lateral support strips 40, all of which are distributed in the longitudinal and lateral directions, constitute a supporting structure based on a grid-type floor frame. A plurality of floor panels 60 which respectively depend on sections enclosed by the longitudinal support strips 20 and the lateral support strips 40 are placed and fixed on the longitudinal upper portions 22 of the longitudinal support strips 20 and the lateral upper portions 42 of the lateral support strips 40, and the joint gap between two floor panels 60 abutting each other will be filled with concrete or silicone.

For a joint embodiment of the longitudinal support strips 20, the lateral support strips 40 and the floor panels 60, a buffer strip 62 extending in the longitudinal direction (X) is provided on the longitudinal upper portion 22 of each longitudinal support strip 20, and another buffer strip 62 extending in the lateral direction (Y) is provided on the lateral upper portion 42 of each lateral support strip 40. Each buffer strip 62 has a lower surface fixed on the longitudinal upper portion 22 or the lateral upper portion 42 and has an upper surface on which the adhesive layer is coated for bonding the floor panel 60. The arrangement of the buffer strips 62 can avoid the floor panels 60 from direct contacting with the longitudinal and lateral support strips 20 and 40, so as to prevent the floor panels 60 from directly pressing down and impacting the longitudinal upper portions 22 of the longitudinal support strips 20 and the lateral upper portions 42 of the lateral support strips 40 when an instant force is applied to the floor panels 60, causing the risk of cracking of the tile or marble floor panels 60. In an embodiment, the upper surface of the buffer strip 62 that is in contact with the bottom of the floor panel 60 preferably has concave knurls or embossing 622. The embossing 622 can not only improve the buffering capacity of the buffer strip 62, but also facilitate the covering of the adhesive layer.

Figure 6:
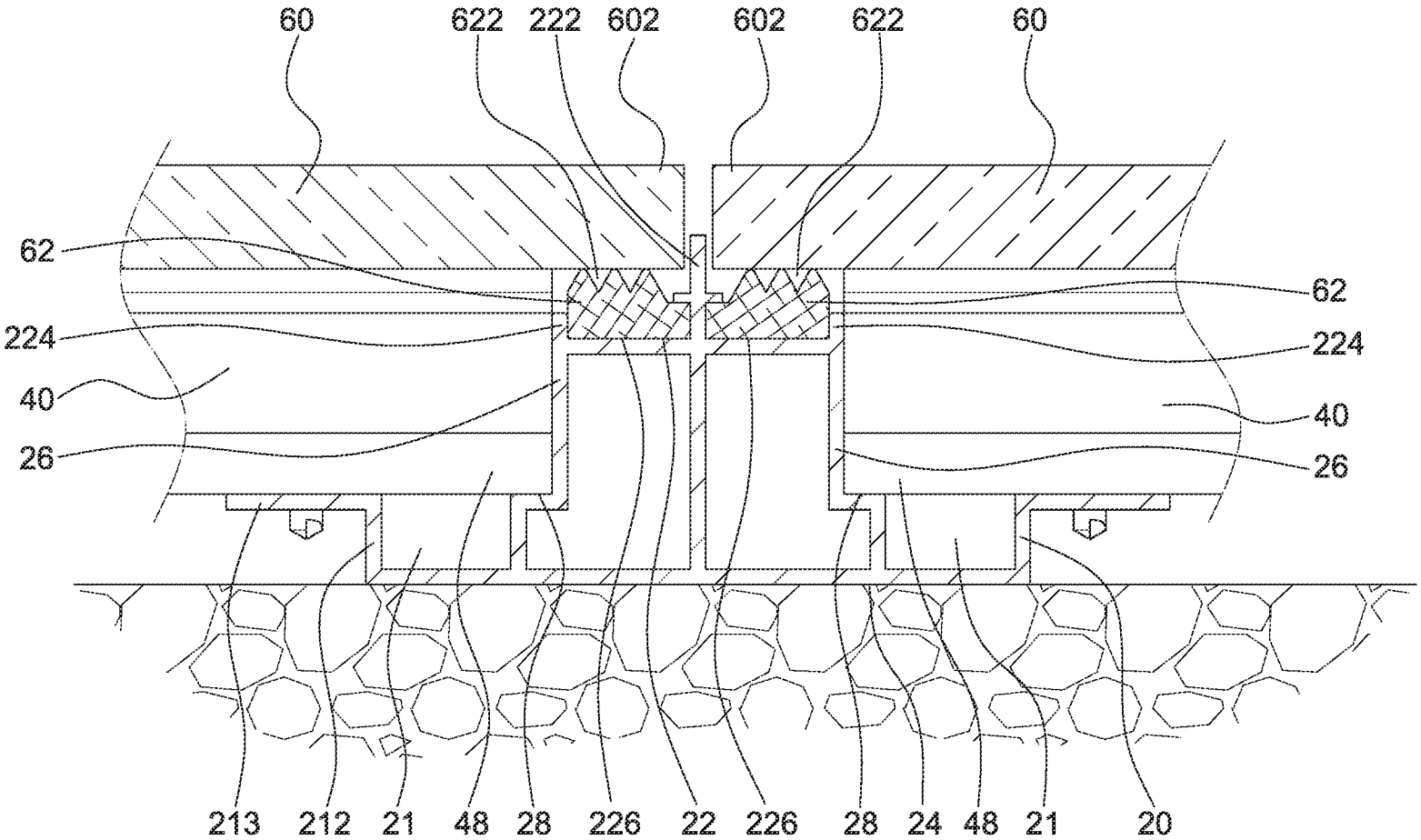
FIG. 6 is a schematic sectional view for the longitudinal support strip in an implementation structure of the present invention.
Figure 7:
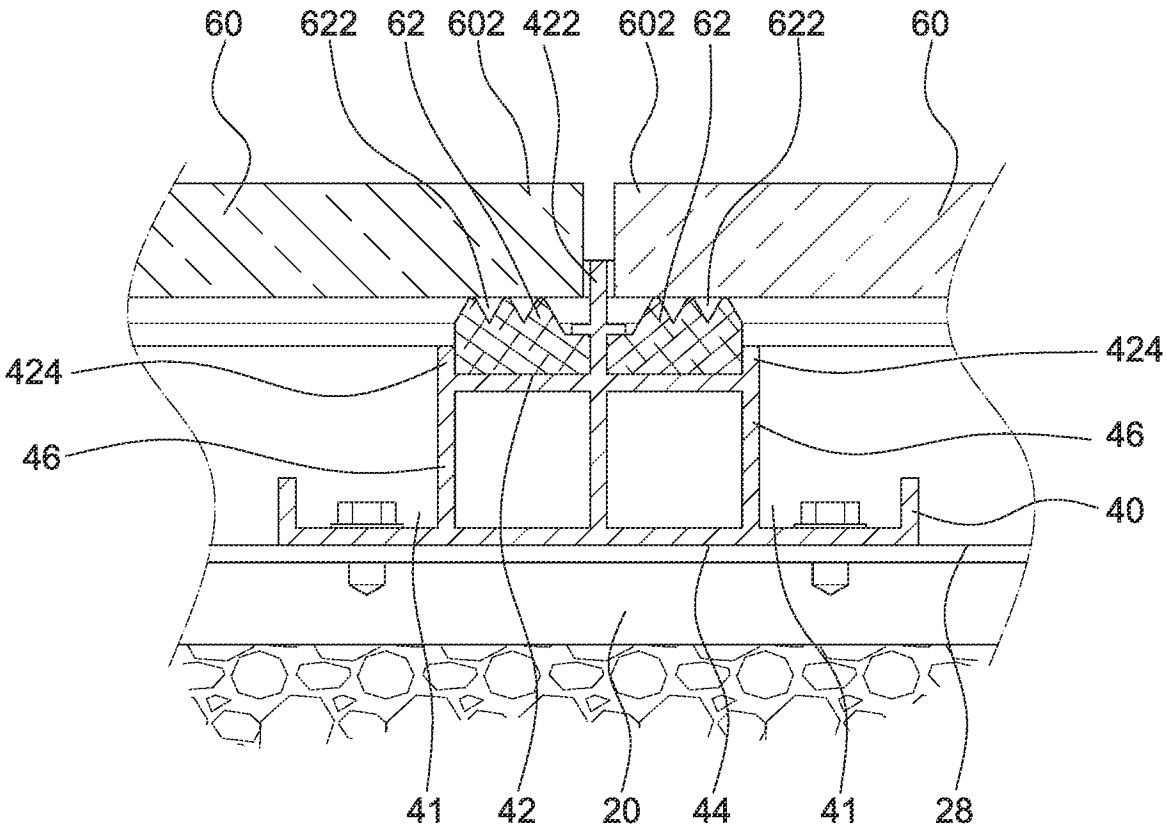
FIG. 7 is a schematic sectional view for the lateral support strip in the implementation structure of the present invention.

For an application of the floor panel 60 placed and fixed on the longitudinal and lateral support strips 20 and 40, a first rib 222 extending in the longitudinal direction (X) and a first fin 422 extending in the lateral direction (Y) are designed on the longitudinal upper portion 22 of the longitudinal support strip 20 and the lateral upper portion 42 of the lateral support strip 40, respectively. The first rib 222 and the first fin 422 enclose an outer edge of a side end (periphery) 602 of the floor panel 60, as shown in FIGS. 6 and 7. An adhesive layer (not shown) such as resin can be applied between the first rib 222 (the first fin 422) and the side end 602 of the floor panel 60 for better lateral fixation on the floor panel 60. In a preferred embodiment, the first rib 222 equally divides the longitudinal upper portion 22 of the longitudinal support strip 20 and is formed between the two longitudinal side walls 26. The first fin 422 equally divides the lateral upper portion 42 of the lateral support strip 40 and is formed between the two lateral side portions 46.

Figure 8:
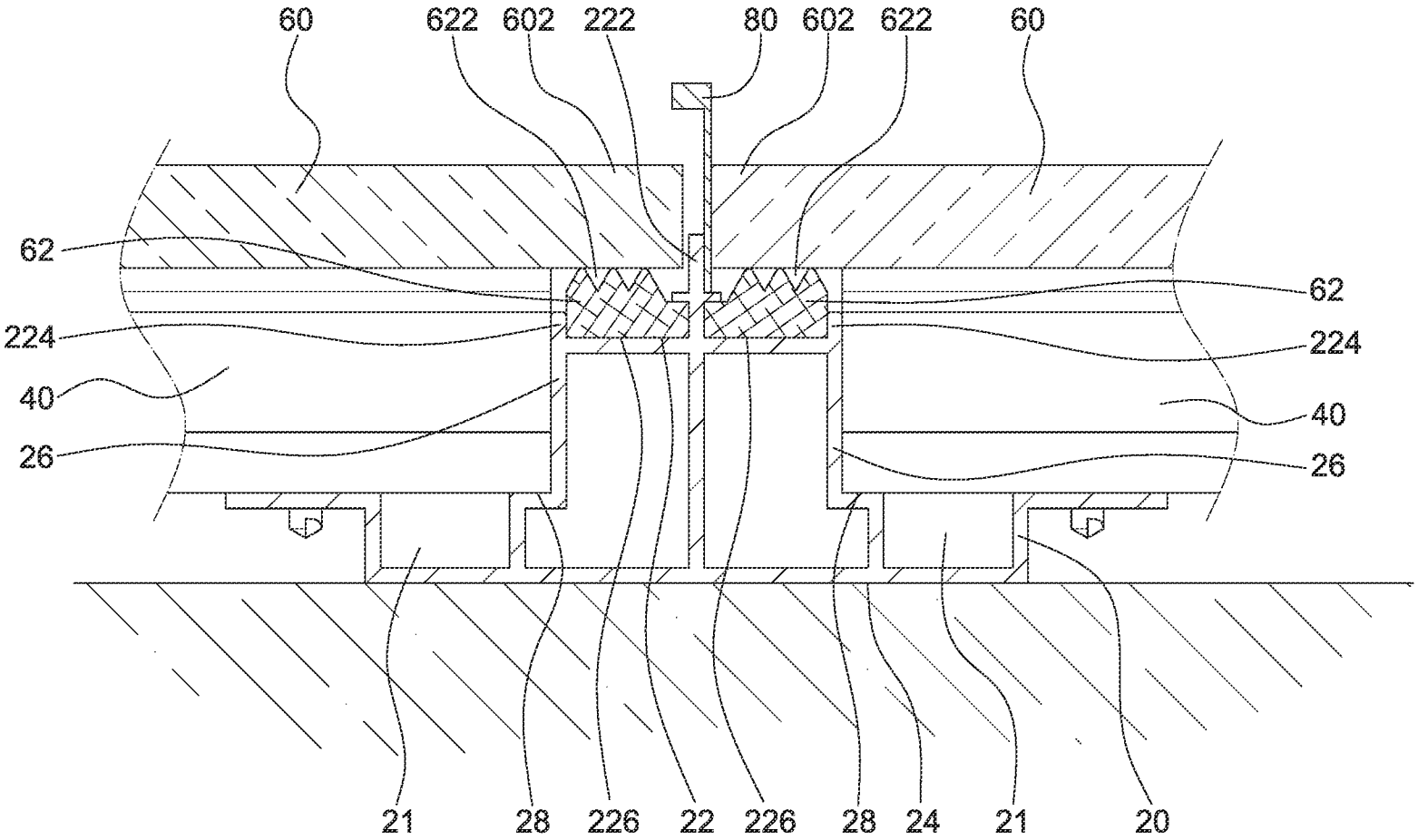
FIG. 8 is a schematic view similar to FIG. 6 for illustrating adjustment of a spacing distance between two floor panels.

As shown in FIG. 8, a spacing piece 80 is provided to abut against the first rib 222 (or the first fin 422) to facilitate the adjustment of the placement position of the floor panel 60 on the longitudinal and lateral support strips 20 and 40 and to maintain the adequate spacing distance between the floor panels 60. The spacing piece 80 having a material thickness abuts between the side end 602 of the floor panel 60 and the first rib 222 (or the first fin 422), thereby defining a predetermined spacing distance between two floor panels 60. The spacing piece 80 is removed after adjusting the spacing distance.

In a preferred embodiment, the longitudinal support strip 20 further includes at least one second rib 224 formed on the longitudinal upper portion 22 and spaced from the first rib 222 for development of a longitudinal groove 226 between the second rib 224 and the first rib 222. The lateral support strip 40 further includes at least one second fin 424 formed on the lateral upper portion 42 and spaced from the first fin 422 for development of a lateral groove 426 between the second fin 424 and the first fin 422. In a feasible embodiment, the grooves 226, 426 are prepared for coating of an adhesive layer therein. In this embodiment with the buffer strips 62 provided, the grooves 226, 426 provide the buffer strips 62 to be embedded and fixed.

In this embodiment, the longitudinal upper portion 22 of the longitudinal support strip 20 is provided with two second ribs 224 which are respectively arranged on two opposite sides of the first rib 222 with a horizontal spacing. The longitudinal groove 226 is formed between each second rib 224 and the first rib 222, and two buffer strips 62 are respectively embedded into the two longitudinal grooves 226. The lateral upper portion 42 of the lateral support strip 40 is provided with two second fins 424 which are respectively arranged on two opposite sides of the first fin 422 with a horizontal spacing. The lateral groove 426 is formed between each second fin 424 and the first fin 422, and two buffer strips 62 are respectively embedded into the two lateral grooves 426.

Figure 5:
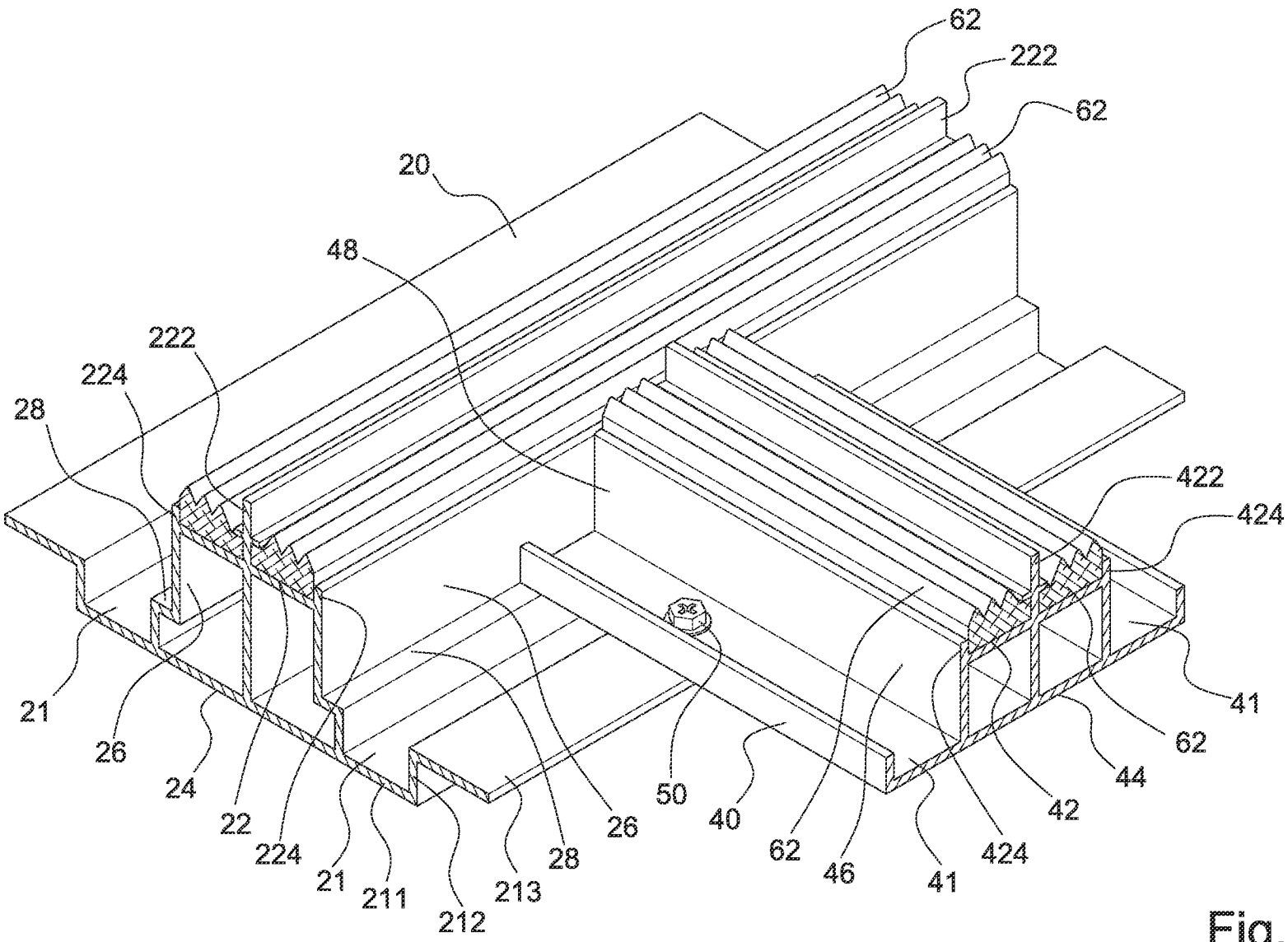
FIG. 5 is a partially schematic view for the longitudinal support strip and the lateral support strip in FIG. 2, both of which have joined together.
Figure 12:
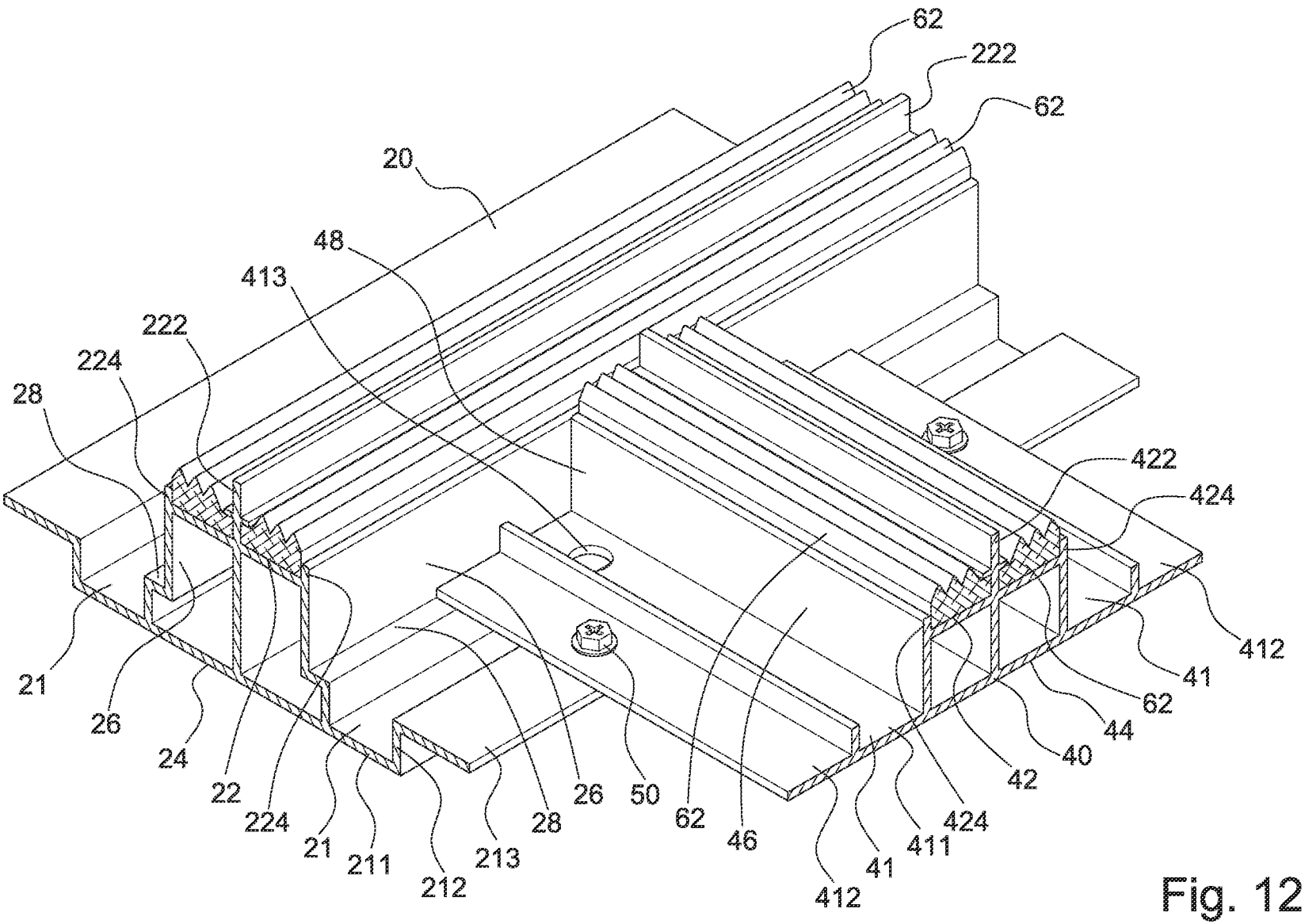
FIG. 12 is a schematic view similar to FIG. 5 for illustrating a further embodiment of the lateral support strip.

For the implementation of preventing leakage, in a feasible embodiment, at least one longitudinal side wall 26 of the longitudinal support strip 20 is provided with a water collection trough 21 extending in the length direction of the longitudinal support strip 20 (extending in the longitudinal direction), and at least one lateral side wall 46 of the lateral support strip 40 is provided with a water drain 41 extending in the length direction of the lateral support strip 40 (extending in the lateral direction). In this embodiment, each of the two longitudinal side walls 26 of the longitudinal support strip 20 is provided with one water collection trough 21, and the two lateral side walls 46 of the lateral support strip 40 each is provided with one water drain 41. The water collection trough 21 is defined by a longitudinal extension strip 211 that extends outward from the longitudinal side wall 26, and the water drain 41 is defined by a lateral extension strip 411 that extends outward from the lateral side wall 46. In this embodiment, two ends of the water drain 41 are respectively located above the water collection troughs 21 of two adjacent longitudinal support strips 20. The water collection trough 21 of the longitudinal support strip 20 is located below the shoulder 28 of the longitudinal support strip 20 in the vertical direction (Z). With reference to FIG. 5, a side wall 212 opposite to the longitudinal side wall 26 extends upward from the outer end of the longitudinal extension strip 211 to define the water collection trough 21 between the longitudinal side wall 26 and the side wall 212, and the upper end of the side wall 212 extends outward with a wing portion 213 in the lateral direction. A height of the wing portion 213 in the vertical direction (Z) is approximately equal to that of the shoulder 28, so that one end 48 of the lateral support strip 40 can be placed on both the shoulder portion 28 and the wing portion 213 of the longitudinal support strip 20 and combined by the fasteners 50 to effectively improve the stability of the lateral support strip 40 placed on the longitudinal support strip 20. With reference to FIG. 12, an outer side of the water drain 41 of the lateral support strip 40 is provided with a coupling portion 412 through which the fastener 50 extends to combine the lateral support strip 40 with the longitudinal support strip 20, so that the fasteners 50 do not hinder the drainage of the water drain 41. In addition, a drainage hole 413 communicating with the water collection trough 21 is provided in the water drain 41.

According to the design of the water collection troughs 21 and the water drains 41, when the floor panels 60 are out of repair for a long time and leakage occurs at the juncture of two adjacent floor panels 60, leaking water from the joint ends of the floor panels 60 in the length direction of the longitudinal support strip 20 will be collected and guided by the water collection trough 21, and then is drained from two ends of the longitudinal support strip 20. Preferably, leaking water is guided to a floor drain provided in the first floor through drainage pathways linking the two ends of the longitudinal support strip 20 for no water permeating the floor and trickling between floors. On the other hand, leaking water from the joint ends of the floor panels 60 in the length direction of the lateral support strip 40 will be collected by the water drain 41 and flow to the two ends of the water drain 41. Then, the leaking water will be further collected by the water collection trough 21 of the longitudinal support strip 20 under guidance of the water drain 41 and is drained from the two ends of the longitudinal support strip 20 under guidance of the water collection trough 21.

Figure 9:
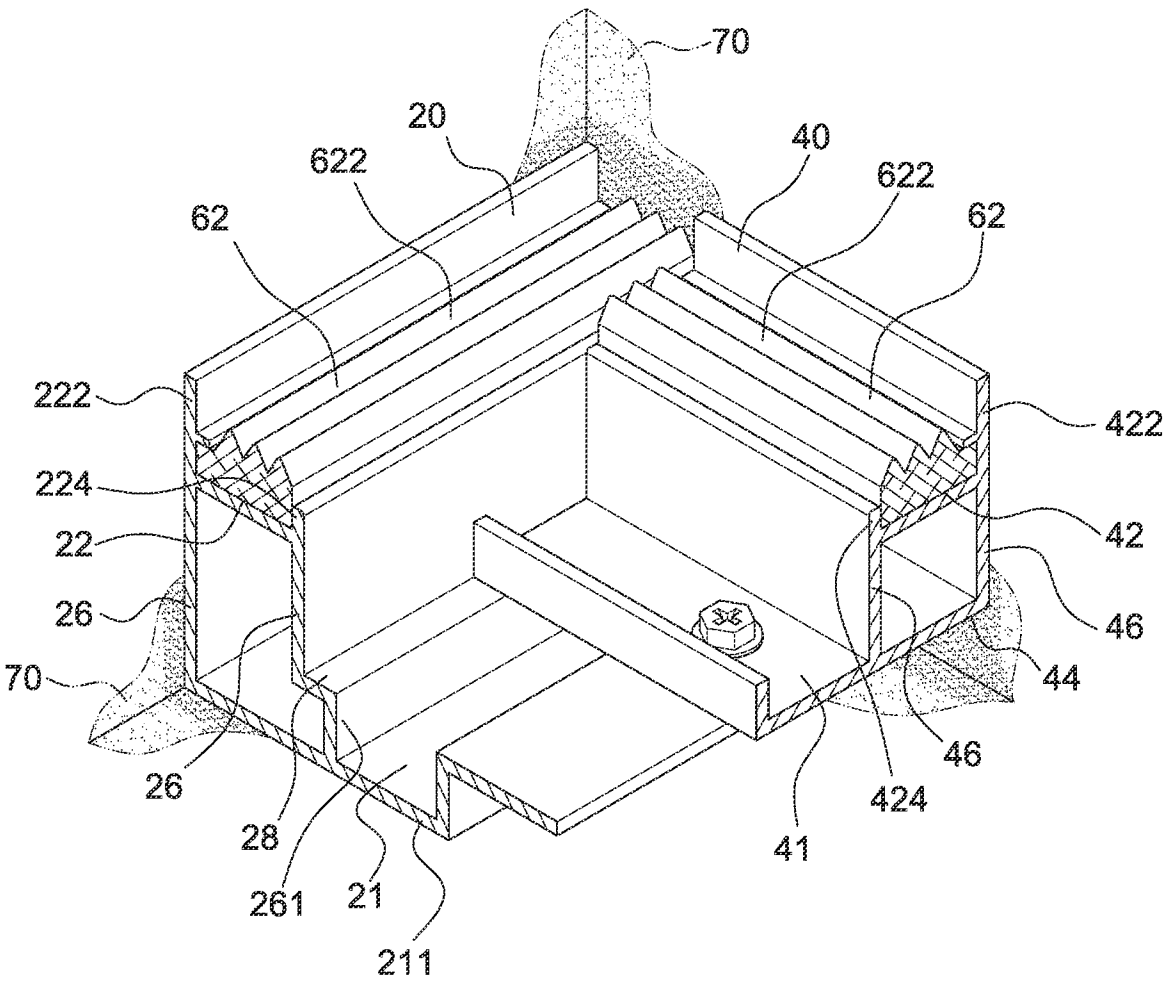
FIG. 9 shows a schematic view of the longitudinal support strip and the lateral support strip in another embodiment.

In an embodiment where the floor frame 10 of the present invention is implemented at edges of the floor (for example, abutting a wall 70), as shown in FIG. 9, the shoulder 28 is designed on the longitudinal side wall 26 of the longitudinal support strip 20 far away from the wall 70, and the first rib 222 extends from the longitudinal side wall 26 opposite to the shoulder 28. The water collection trough 21 extends at a lower end 261 of the longitudinal side wall 26 provided with the shoulder 28. The first fin 422 of the lateral support strip 40 extends from the lateral side portion 46 adjacent to the wall 70, and the water drain 41 extends at the lateral side portion 46 opposite to the first fin 422, or it can be called the water drain 41 extends at the lateral side portion 46 away from the wall 70.

Figure 10:
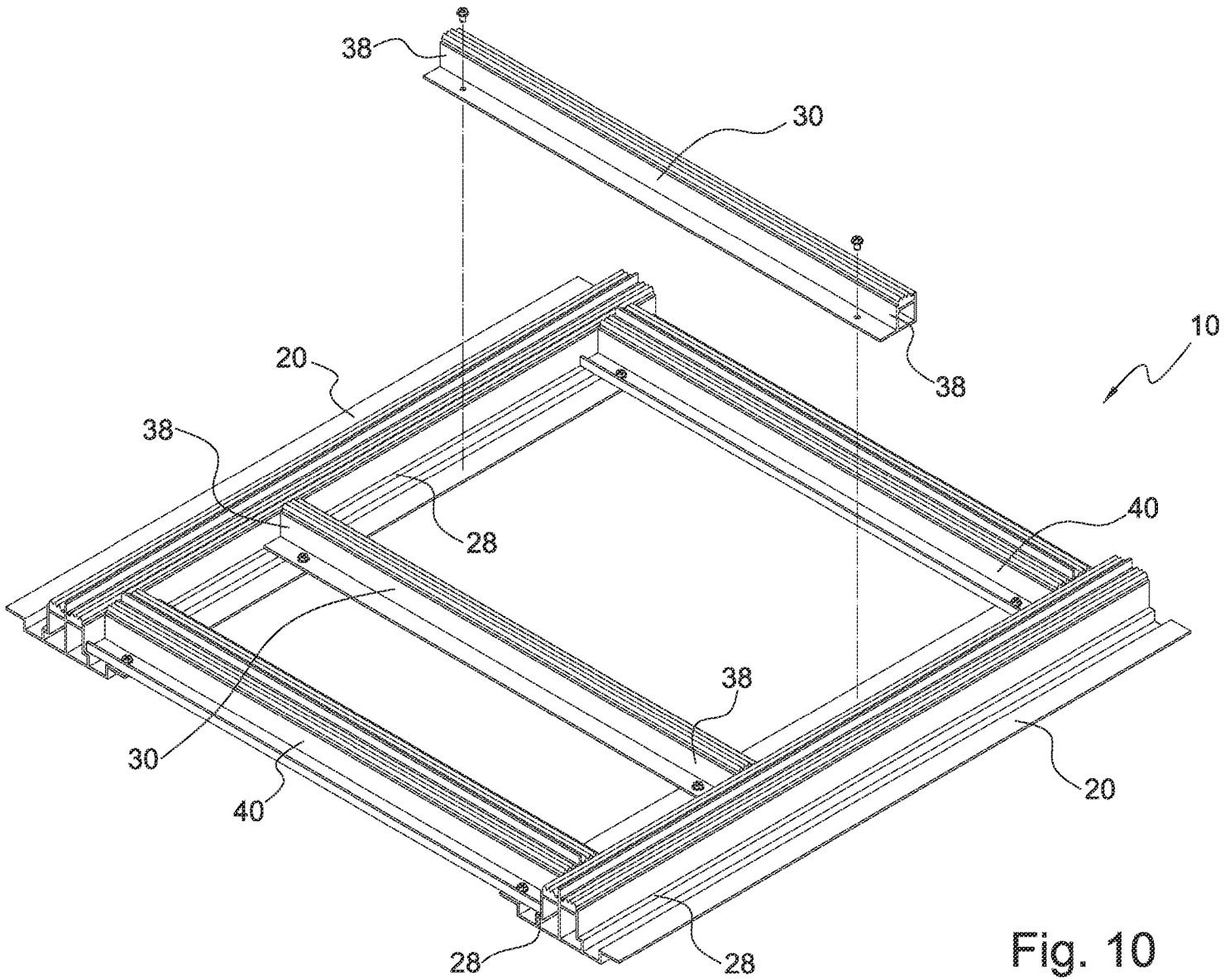
FIG. 10 is a schematic view illustrating the floor frame of the present invention provided with reinforcing strips.
Figure 11:
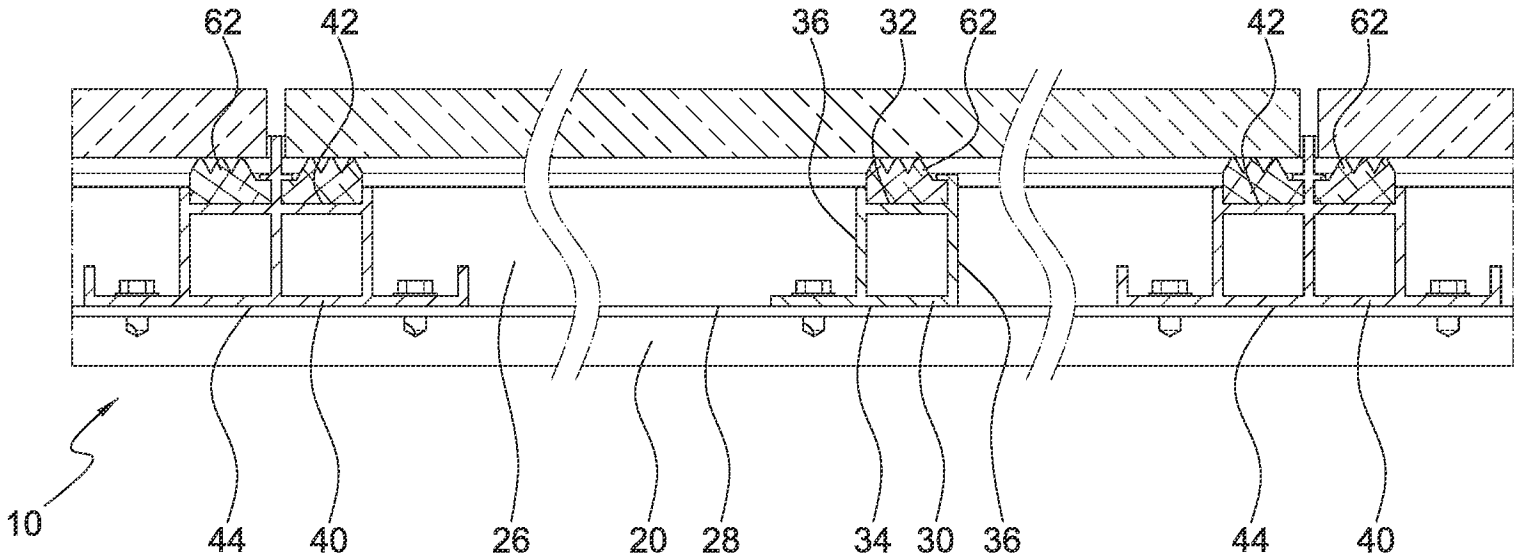
FIG. 11 shows a schematic sectional view of the reinforcing strip and the lateral support strips in FIG. 10.

Referring to FIGS. 10 and 11, for a large-size floor panel 60 mounted on the floor frame 10, the floor frame 10 may further include at least one reinforcing strip 30 to strengthen the support for the floor panel 60 between two adjacent longitudinal support strips 20 and between two adjacent lateral support strips 40. The reinforcing strip 30 has an elongate strip body extending in the lateral direction (Y) and includes upper and lower faces 32 and 34 spaced in the vertical direction (Z) and a pair of side walls 36 opposed and spaced in the longitudinal direction (X). A vertical distance between the upper face 32 and the lower face 34 is approximately equal to the vertical distance between the lateral upper portion 42 and the lateral lower portion 44 of the lateral support strip 40.

At least one reinforcing strip 30 is installed between two lateral support strips 40, and each end 38 of the reinforcing strip 30 is placed at the shoulder 28 of a corresponding longitudinal support strip 20. The upper face 32 of the reinforcing strip 30 supports the floor panel 60 for a stronger braced force applied on the floor panel 60.

In the embodiment where the longitudinal upper portion 22 of the longitudinal support strip 20 and the lateral upper portion 42 of the lateral support strip 40 have the buffer strips 62, the buffer strip 62 extending in the lateral direction can be designed on the upper face 32 of the reinforcing strip 30.

The scope of the present disclosure is to be indicated by the appended claims, rather than by the foregoing description, and all changes which come within the meaning and range of equivalency of the claims are intended to be embraced therein.

The invention claimed is:

1. A floor frame comprising:

at least two spaced longitudinal support strips each having an elongate strip body extending in a longitudinal direction of the floor frame, with each longitudinal support strip including longitudinal upper and lower portions spaced in a vertical direction perpendicular to the longitudinal direction and a pair of longitudinal side walls spaced in a lateral direction perpendicular to the longitudinal and vertical directions, with a shoulder designed on at least one of the pair of longitudinal side walls and located between the longitudinal upper and lower portions, wherein two shoulders of the two longitudinal support strips are opposite to each other; and at least one lateral support strip having an elongate strip body extending in the lateral direction, with the lateral support strip including two ends spaced in the lateral direction, with the lateral support strip further including lateral upper and lower portions spaced in the vertical direction and a pair of lateral side walls spaced in the longitudinal direction, wherein the two ends of the lateral support strip are placed on the two opposite shoulders of the two longitudinal support strips, respectively, wherein the longitudinal upper portion of the longitudinal support strip is provided with a first rib extending in the longitudinal direction, and the lateral upper portion of the lateral support strip is provided with a first fin extending in the lateral direction, wherein the longitudinal upper portion of the longitudinal support strip is further provided with at least one second rib extending in the longitudinal direction and spaced from the first rib, and the lateral upper portion of the lateral support strip is further provided with at least one second fin extending in the lateral direction and spaced from the first fin, wherein a first buffer strip is embedded between the first rib and the at least one second rib, and a second buffer strip is embedded between the first fin and the at least one second fin.

2. A floor frame comprising:

at least two spaced longitudinal support strips each having an elongate strip body extending in a longitudinal direction of the floor frame, with each longitudinal support strip including longitudinal upper and lower portions spaced in a vertical direction perpendicular to the longitudinal direction and a pair of longitudinal side walls spaced in a lateral direction perpendicular to the longitudinal and vertical directions, with a shoulder designed on at least one of the pair of longitudinal side walls and located between the longitudinal upper and lower portions, wherein two shoulders of the two longitudinal support strips are opposite to each other; and at least one lateral support strip having an elongate strip body extending in the lateral direction, with the lateral support strip including two ends spaced in the lateral direction, with the lateral support strip further including lateral upper and lower portions spaced in the vertical direction and a pair of lateral side walls spaced in the longitudinal direction, wherein the two ends of the lateral support strip are placed on the two opposite shoulders of the two longitudinal support strips, respectively, wherein at least one longitudinal side wall of the longitudinal support strip is provided with a water collection trough extending in the longitudinal direction, and at least one lateral side wall of the lateral support strip is provided with a water drain extending in the lateral direction.

3. The floor frame as claimed in claim 2, wherein a vertical distance between the lateral upper portion and the lateral lower portion of the lateral support strip is approximately equal to a vertical distance between the longitudinal upper portion and the shoulder of the longitudinal support strip.

4. The floor frame as claimed in claim 2, wherein the longitudinal upper portion of the longitudinal support strip is provided with a first rib extending in the longitudinal direction, and the lateral upper portion of the lateral support strip is provided with a first fin extending in the lateral direction.

5. The floor frame as claimed in claim 4, wherein the first rib of the longitudinal support strip extends from the longitudinal side wall opposite to the shoulder of the longitudinal support strip, with the water collection trough extending at a lower end of the longitudinal side wall provided with the shoulder, wherein the first fin of the lateral support strip extends from one of the two lateral side portions, with the water drain extending at the lateral side portion opposite to the first fin.

6. The floor frame as claimed in claim 4, wherein the longitudinal upper portion of the longitudinal support strip is further provided with at least one second rib extending in the longitudinal direction and spaced from the first rib, and the lateral upper portion of the lateral support strip is further provided with at least one second fin extending in the lateral direction and spaced from the first fin.

7. The floor frame as claimed in claim 6, wherein the longitudinal upper portion of the longitudinal support strip is provided with two second ribs which are respectively arranged on two sides of the first rib.

8. The floor frame as claimed in claim 6, wherein the lateral upper portion of the lateral support strip is provided with two second fins which are respectively arranged on two sides of the first fin.

9. The floor frame as claimed in claim 2, wherein at least one buffer strip is designed on both the longitudinal upper portion of each longitudinal support strip and the lateral upper portion of each lateral support strip.

10. The floor frame as claimed in claim 9, wherein the buffer strip has an upper surface provided with embossing.

11. The floor frame as claimed in claim 2, wherein a longitudinal extension strip extends outward from the longitudinal side wall of the longitudinal support strip, and a side wall opposite to the longitudinal side wall extends upward from an outer end of the longitudinal extension strip to define the water collection trough between the longitudinal side wall and the side wall, with a wing portion extending outward from an upper end of the side wall in the lateral direction and having a height in the vertical direction which is approximately equal to a height of the shoulder in the vertical direction, wherein one of the two ends of the lateral support strip is placed on both the shoulder portion and the wing portion of the longitudinal support strip.

12. The floor frame as claimed in claim 11, wherein a lateral extension strip extends outward from the lateral side wall of the lateral support strip to define the water drain, and an outer side of the water drain of the lateral support strip is provided with a coupling portion, with a fastener extending through both the coupling portion of the lateral support strip and the wing portion of the longitudinal support strip to combine the lateral support strip with the longitudinal support strip.

13. The floor frame as claimed in claim 2, wherein a lateral extension strip extends outward from the lateral side wall of the lateral support strip to define the water drain, and an outer side of the water drain of the lateral support strip is provided with a coupling portion through which a fastener extends to combine the lateral support strip with the longitudinal support strip.

14. A floor frame comprising:

at least two spaced longitudinal support strips each having an elongate strip body extending in a longitudinal direction of the floor frame, with each longitudinal support strip including longitudinal upper and lower portions spaced in a vertical direction perpendicular to the longitudinal direction and a pair of longitudinal side walls spaced in a lateral direction perpendicular to the longitudinal and vertical directions, with a shoulder designed on at least one of the pair of longitudinal side walls and located between the longitudinal upper and lower portions, wherein two shoulders of the two longitudinal support strips are opposite to each other;

at least one lateral support strip having an elongate strip body extending in the lateral direction, with the lateral support strip including two ends spaced in the lateral direction, with the lateral support strip further including lateral upper and lower portions spaced in the vertical direction and a pair of lateral side walls spaced in the longitudinal direction, wherein the two ends of the lateral support strip are placed on the two opposite shoulders of the two longitudinal support strips, respectively; and at least one reinforcing strip having an elongate strip body extending in the lateral direction, with the reinforcing strip including upper and lower faces spaced in the vertical direction and a pair of side walls spaced in the longitudinal direction, wherein a vertical distance between the upper face and the lower face of the reinforcing strip is approximately equal to a vertical distance between the lateral upper portion and the lateral lower portion of the lateral support strip, wherein two ends of the reinforcing strip are placed on the two opposite shoulders of the two longitudinal support strips, respectively.

* * * * *